US008360024B2

(12) United States Patent
Moritz et al.

(10) Patent No.: US 8,360,024 B2
(45) Date of Patent: Jan. 29, 2013

(54) METHOD AND DEVICE FOR CONTROLLING AT LEAST ONE GLOW PLUG OF A MOTOR VEHICLE

(75) Inventors: Rainer Moritz, Filderstadt (DE); Wolfgang Dressler, Vaihingen/Enz (DE); Eberhard Janzen, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 540 days.

(21) Appl. No.: 12/223,232

(22) PCT Filed: Jan. 2, 2007

(86) PCT No.: PCT/EP2007/050011

§ 371 (c)(1),
(2), (4) Date: Jul. 16, 2010

(87) PCT Pub. No.: WO2007/090688

PCT Pub. Date: Aug. 16, 2007

(65) Prior Publication Data

US 2010/0280735 A1 Nov. 4, 2010

(30) Foreign Application Priority Data

Feb. 8, 2006 (DE) ..... 10 2006 005 710

(51) Int. Cl.
*F02B 9/08* (2006.01)

(52) U.S. Cl. ..... 123/145 A

(58) Field of Classification Search ..... 123/145 A, 123/143 R; 701/113; 219/145 A
See application file for complete search history.

(56) References Cited

U.S. PATENT DOCUMENTS

| | | | | |
|---|---|---|---|---|
| 4,519,353 | A * | 5/1985 | Ito et al. | 123/359 |
| 4,519,366 | A * | 5/1985 | May | 123/435 |
| 4,639,871 | A | 1/1987 | Sakai et al. | |
| 7,122,764 | B1 * | 10/2006 | Bauer et al. | 219/270 |

FOREIGN PATENT DOCUMENTS

| | | |
|---|---|---|
| CN | 1472432 | 2/2004 |
| DE | 27 43 788 | 4/1979 |
| EP | 0 894 976 | 2/1999 |
| GB | 2 159 578 | 12/1985 |
| JP | 58 200080 | 11/1983 |
| JP | 3-105043 | 5/1991 |
| JP | 8-241736 | 9/1996 |
| JP | 10 274144 | 10/1998 |
| JP | 2002-276524 | 9/2002 |
| WO | WO 01/20229 | 3/2001 |

* cited by examiner

*Primary Examiner* — John Kwon
(74) *Attorney, Agent, or Firm* — Kenyon & Kenyon LLP

(57) ABSTRACT

A device and a method for controlling at least one glow plug of a motor vehicle are described. The at least one glow plug is controlled as a function of the operating state of the internal combustion engine. In this case, the control is effected as a function of a variable which depends on the exhaust gas temperature and/or as a function of the fulfillment of a fuel quantity condition and/or time condition.

5 Claims, 5 Drawing Sheets

METHOD AND DEVICE FOR CONTROLLING AT LEAST ONE GLOW PLUG OF A MOTOR VEHICLE

BACKGROUND INFORMATION

Standardly, the glow plugs are used to heat the combustion chambers when the internal combustion engine is started. The controlling of the at least one glow plug takes place dependent on the operating state of the internal combustion engine.

SUMMARY OF THE INVENTION

According to the present invention, it is recognized that in certain operating states the exhaust gas emissions can be significantly reduced if the controlling of the glow plugs takes place dependent on a quantity that is dependent on the exhaust gas temperature and/or on the fulfillment of a fuel condition.

Thus, the smoke emissions can be significantly reduced in particular in the case of a change in engine operation when the motor is cool. In particular, the white smoke and/or black smoke can be significantly reduced during the transition from overrun operation to normal driving operation. According to the present invention, it is recognized that in longer overrun operation or longer travel uphill, during which in particular a small quantity of fuel or no fuel at all is injected, the combustion chambers cool off. If an injection with a higher fuel quantity subsequently takes place, this results in increased smoke emissions. According to the present invention, this cooling is counteracted by corresponding controlling of the glow plugs. Preferably, it is provided that, given the presence of particular conditions, the glow plugs are supplied with current in such a way that they are preheated. The goal of this preheating is for the operating temperature of the glow plugs to be reached in a very short time (e.g. <0.55) when there is a change in engine operation, in particular when there is a jump-type increase in the injected fuel quantity. Preferably, the magnitude and gradient of the preheating are designed to be moderate enough that the life span of the glow plugs is adversely affected as little as possible. As conditions, the exhaust gas temperature and/or fuel quantity over time are preferably used. If this exhaust gas temperature falls below a particular threshold value, the glow process is initiated. Correspondingly, the glow process is initiated if the fuel quantity is below a threshold value for a particular time period. Preferably, the glow process is initiated if the fuel quantity assumes the value zero for a particular time period. Alternatively, it can also be provided that the two conditions are combined. This can for example be realized such that monitoring takes place for the presence of the two conditions, and the glow process is initiated if one of the two conditions are met.

During the glowing, the controlling of the glow plugs takes place dependent on the operating parameters of the internal combustion engine, such as in particular the engine rotational speed, the fuel quantity, the external temperature, and/or the exhaust gas temperature. In this way, sufficient energy can be supplied to the glow plugs to achieve a sufficient thermal support of the combustion process. In addition, however, the unnecessary supplying of energy to the glow plugs, which could result in an overheating of the glow plugs or even damage to the glow plugs, is prevented.

DETAILED DESCRIPTION

Figure 1:
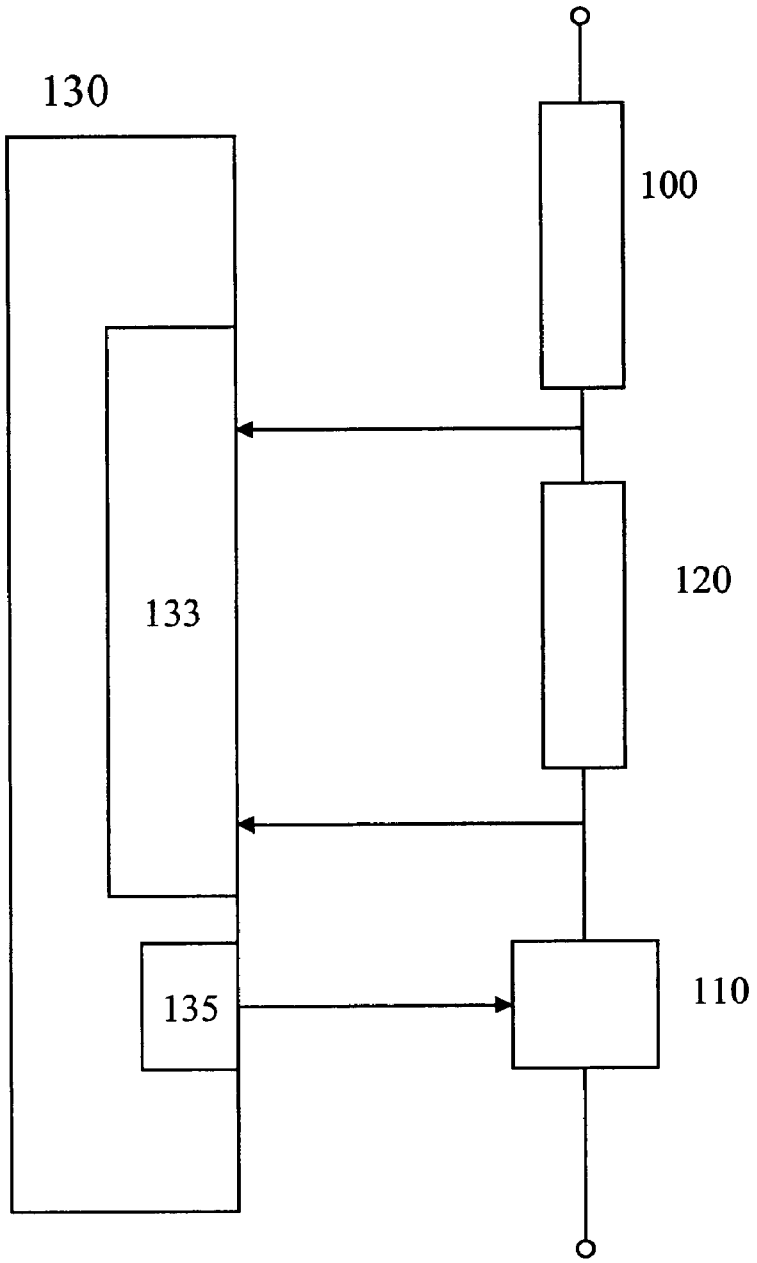
FIG. 1 shows important elements of a device for controlling at least one glow plug.

In FIG. 1, the important elements of the device according to the present invention are shown. A glow plug 100 is connected in series with a current measuring device 120 and a switching device 110, between the two terminals of a voltage supply. In the depicted exemplary embodiment, for each glow plug there is provided one current measuring device 120 and one switching device 110. An embodiment of the device according to the present invention can also be designed such that a common switching device and/or a common current measuring device is provided for a plurality of glow plugs of an internal combustion engine, or for all glow plugs of an internal combustion engine.

The depicted specific embodiment, in which each glow plug is allocated one current measuring device 120 and one switching device 110, offers the advantage that the glow plug can be controlled individually and the current flowing through the glow plug can be evaluated. If a plurality of glow plugs are combined to form a group, or if all glow plugs are controlled in common via a switching device or the current is evaluated in common, this offers the advantage that expensive elements such as the switching device can be omitted, resulting in a significant savings in cost. However, this has the disadvantage that only a common controlling or a common evaluation of the current of some or all glow plugs is then possible.

In addition, a control unit 130 is provided that, in addition to other components not shown, includes an evaluation unit 133 and a control unit 135. Control unit 135 controls switching device 110 in order to supply a desired amount of energy to the glow plug. Evaluation unit 133 evaluates the voltage dropped at current measuring device 120 in order to determine the current flowing through the glow plug. Current measuring device 120 is preferably fashioned as an ohmic resistance.

In addition to the controlling of the glow plug provided in normal operation of the glow plug, in order to shorten the ignition delay when the internal combustion engine is started it is provided that in certain operating states of the internal combustion engine the glow plugs are controlled so as to prevent a cooling of the combustion chambers. According to the present invention, it was recognized that in longer overrun operation, during which no fuel is injected, the internal combustion engine cools. As soon as the internal combustion engine has been in overrun operation for a longer period of time, i.e. between 2 and 3 minutes, an increased emission of smoke occurs when gas is then given, i.e. when fuel is injected. This happens for example when the vehicle is driven downhill for a longer period of time, and no fuel is injected, and subsequently the driver gives the vehicle gas in order to accelerate the vehicle on a flat stretch or uphill, or to keep the speed constant. Here, it was recognized that this effect is due essentially to a cooling of the piston walls. This preferably takes place in a period of time of 2 to 3 minutes after the termination of the injection. The cooling of the complete engine block, including the coolant water, takes place only after a later point in time, i.e. after about 15 minutes. According to the present invention, this cooling can be counteracted as follows: as soon as a corresponding operating state is recognized, a pre-application of current is made to the glow plugs in order to bring them to a low temperature level, so that these pre-temperature-regulated glow plugs can be brought to the required glow temperature within a very short time by applying an increased operating voltage. The pre-temperature regulation is realized such that the glow plugs can be brought to the maximum glow temperature within a time span that is significantly less than half a second. Normally, the internal combustion engine, in particular the piston walls, warms up within a time span of 2 to 3 seconds. After this time period, the cylinder inner walls are correspondingly temperature-regulated by the combustion, and no smoke emissions then take place. After this time has elapsed, the glow process can then be terminated or reduced to a significantly lower current level.

Figure 2:
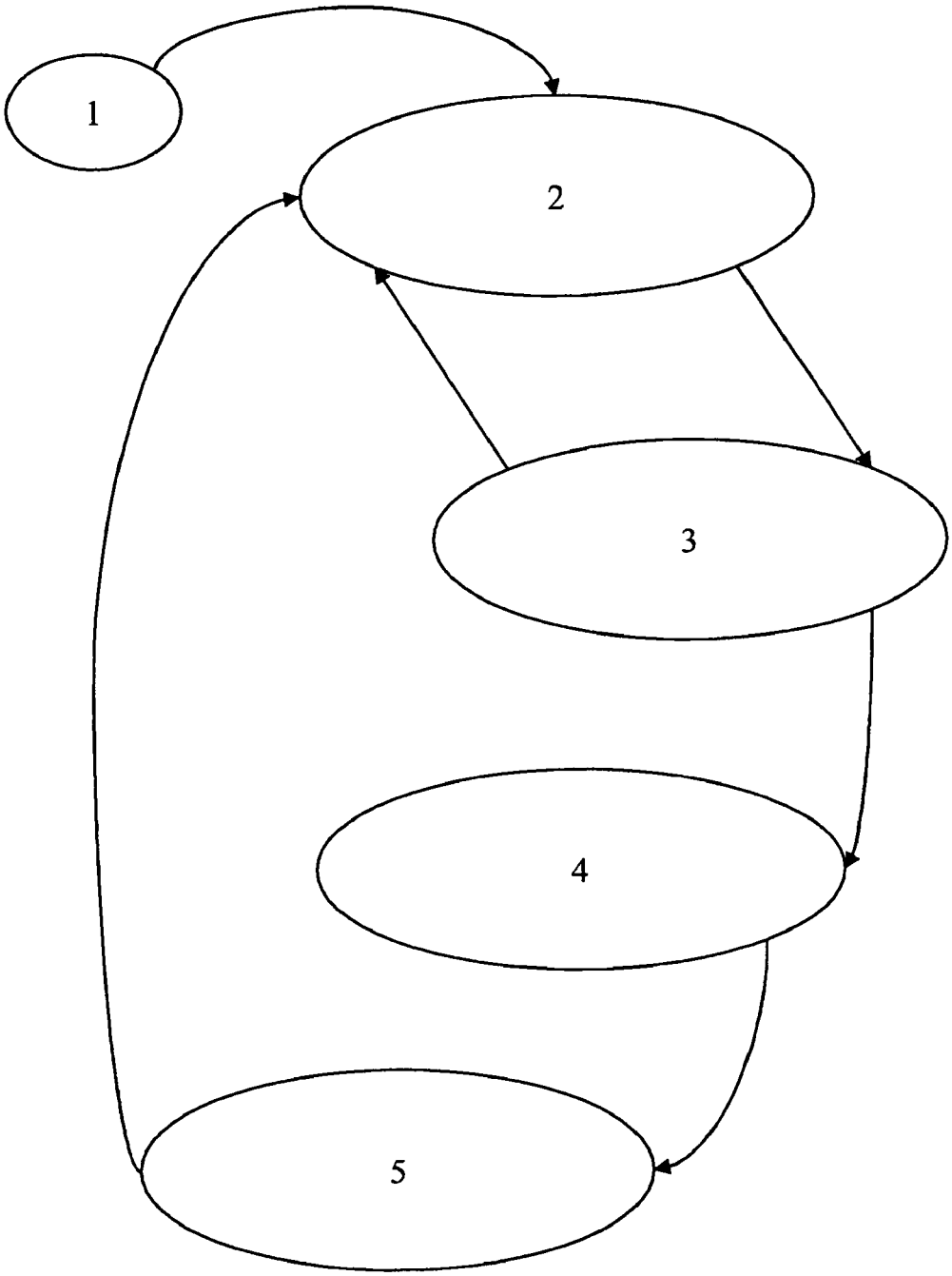
FIG. 2 shows a state diagram.

FIG. 2 shows the various states of such a process. In a first step, the program sequence is initiated. In a second state 2, it is determined whether a glow process is introduced.

Figure 3A:
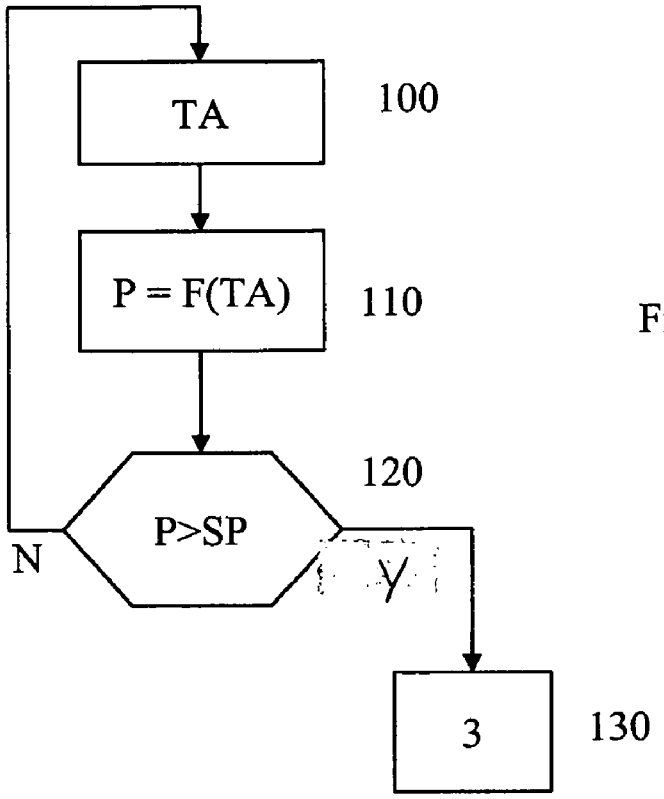
FIGS. 3*a*, 3*b*, 4, 5 and 6 each show a flow diagram of the procedure according to the present invention.
Figure 3B:
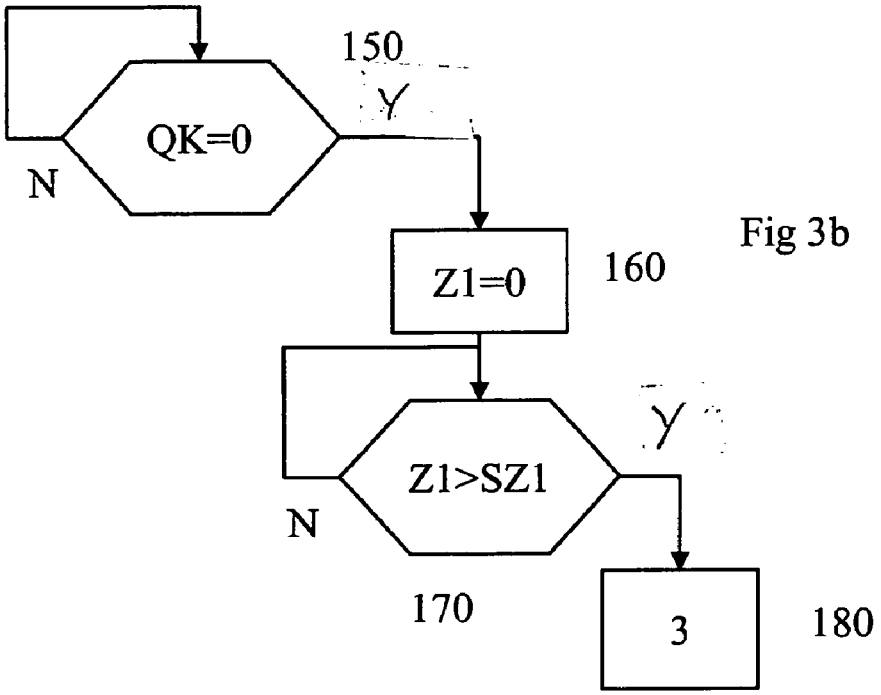

This state 2 is shown in detail in FIGS. 3*a* and 3*b*. In a first step 100, exhaust gas temperature TA is determined. In a second step 110, based on exhaust gas temperature TA a parameter P is determined. The following query 120 checks whether this parameter P is greater than a threshold value SP. If this is not the case, step 100 takes place again. If this is the case, the sequence moves to state 3. In this specific embodiment, based on the exhaust gas temperature, and possibly on other quantities, a parameter P is determined that represents a measure of how much the cylinder walls have cooled. If this parameter P exceeds a particular threshold value SP, the process moves to state 3.

This transition to the third state can also take place in the manner according to the specific embodiment shown in FIG. 3*b*. In a first step 150, it is checked whether the fuel quantity QK that is injected into the internal combustion engine assumes the value zero. If this is the case, in step 160 a time counter Z1 is set to zero. The subsequent query 170 checks whether time counter Z1 is greater than a time threshold SZ1. If this is the case, in step 180 the process moves to state 3. That is, if in state 2 it is recognized that no fuel was metered for a period of time longer than time span SZ1, the process moves to state 3. Alternatively to the query whether the metered fuel quantity assumes the value zero, it can also be provided to monitor whether a fuel quantity is metered that is less than a minimum value.

Figure 4:
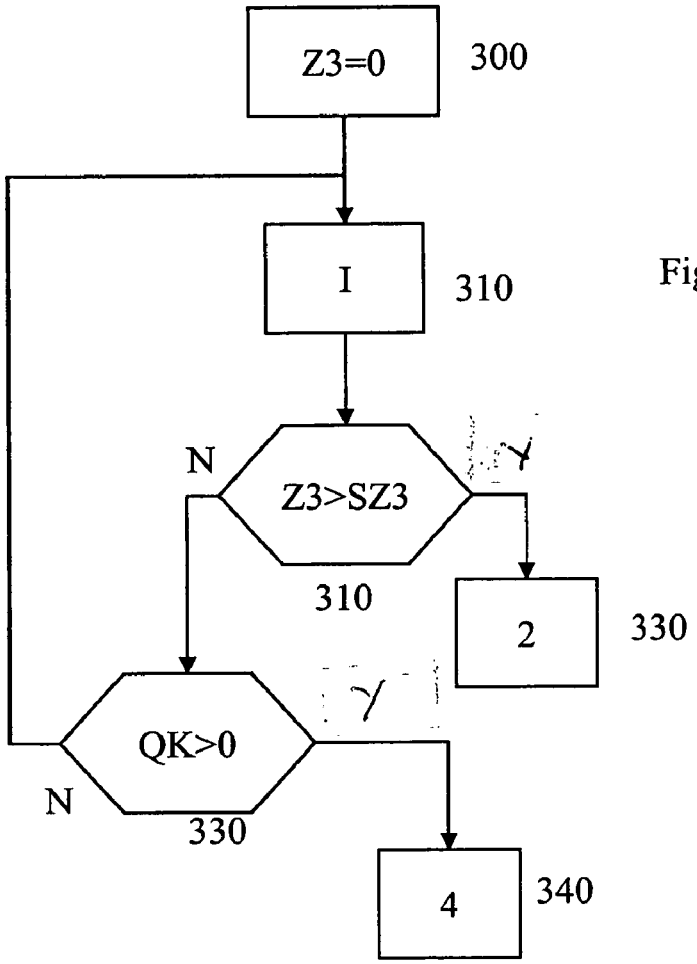

The pre-conditioning of the glow plug takes place in state 3; i.e., it is charged with a low current so that it reaches a particular temperature. On the basis of this temperature, the glow plug can be heated very quickly to the final temperature. Standardly, the glow plug is heated to a temperature of about 600° to 700°. State 3 is shown in detail in FIG. 4. In a first step 300, a time counter Z3 is set to zero. Subsequently, in step 310, the current is determined that has to flow through the glow plug for the pre-conditioning. This current value with which the conditioning takes place is specified dependent on various operating parameters. Such parameters include for example the rotational speed of the internal combustion engine, the external temperature, and/or the exhaust gas temperature TA. The following query 320 checks whether the value of counter Z3 is greater than a threshold value SZ3. If this is the case, in step 330 the process returns to state 2. If this is not the case, query 330 checks whether fuel quantity QK is greater than zero. If query 330 finds that the fuel quantity is greater than zero, i.e. fuel is again being metered, in step 340 the process moves into state 4. If the fuel quantity is still less than zero or less than a minimum value, step 310 is repeated.

During the pre-conditioning in state 3, the glow plug is pre-charged with a particular current value that is dimensioned such that the glow plug heats to approximately 600° to 700°. This current value is prespecified dependent on the operating state of the internal combustion engine, in particular the engine rotational speed, the external temperature, and/or the exhaust gas temperature. If this state lasts longer than a time threshold SZ3, the process moves to state 2. As soon as it is recognized that fuel is being metered, the process moves into state 4.

Figure 5:
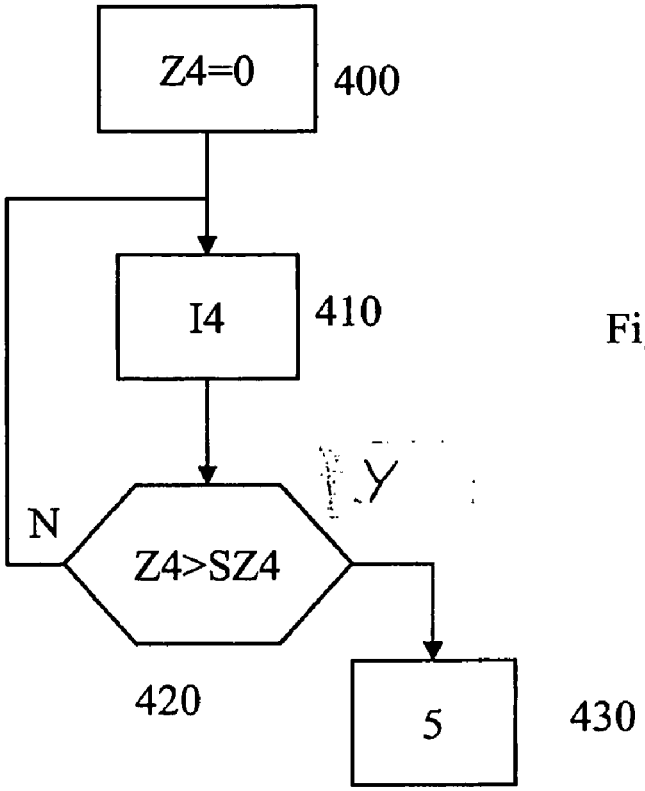

In state 4, also called pushing, the glow plug is supplied with enough energy that it reaches its maximum temperature as quickly as possible. This also takes place only for a particular time duration SZ4. The corresponding procedure is shown in detail in FIG. 5. In a first step 400, a time counter SZ4 is set to zero. Subsequently, in step 410, the current I4 that flows in this state is specified dependent on the state of the internal combustion engine and/or on the state of the glow plugs. Here, inter alia, the energy already supplied to the glow plug is taken into account. Subsequently, in step 420 it is checked whether time counter Z4 has exceeded a threshold value SZ4. If this is not the case, step 410 is repeated. Otherwise, in step 430 the process moves to state 5.

Figure 6:
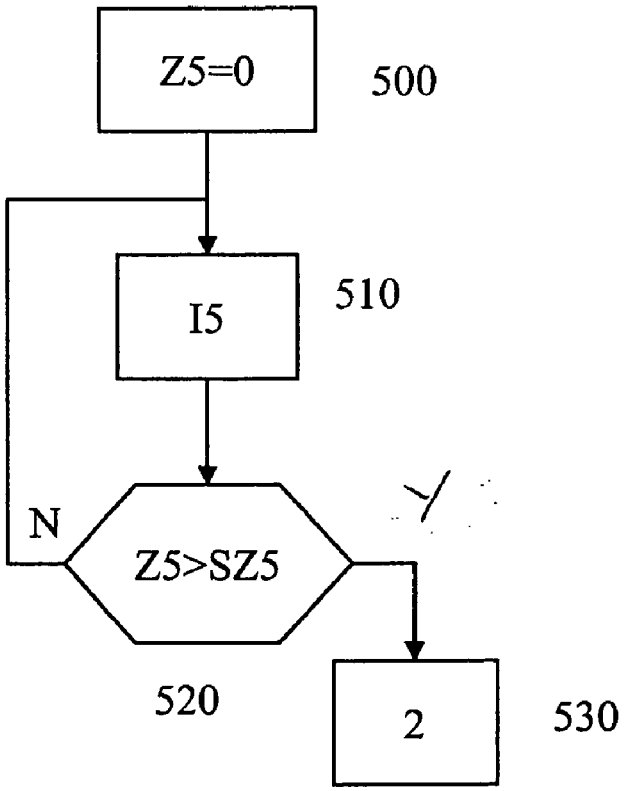

In state 5, the glow plug is operated with nominal voltage. This takes place for a particular time duration SZ5. The corresponding procedure is shown in FIG. 6. In a first step 500, a time counter Z5 is set to zero. Subsequently, in step 510 the current value I5 is specified. The subsequent query 520 checks whether time duration SZ5 has been exceeded. If this is not the case, step 510 is repeated. Otherwise, in step 530 the transition to state 2 takes place.

According to the present invention, it is provided that in a state of the internal combustion engine in which there is the danger that the combustion chamber will cool, the glow plugs are supplied with current according to a predetermined schema. In a first phase, the glow plugs are pre-conditioned so that they reach a particular temperature from which the final temperature of the glow plugs is reached rapidly. When overrun operation ends, i.e. fuel is again injected, the glow plugs are supplied with current in such a way that they reach their maximum temperature as quickly as possible so that the combustion chambers are quickly heated. After the elapsing of a particular time, the glow plugs are operated for a further period of time with nominal voltage. That is, in this time phase they are operated in such a way that they maintain their temperature.

Thus, according to the present invention it is provided that in overrun operation a glow process takes place that is similar to the one that takes place when the internal combustion engine is started. Differing from the starting of the internal combustion engine, there takes place a relatively long pre-glowing phase in which the glow plugs are pre-conditioned, such that the actual glowing process is introduced as soon as the overrun phase ends. The actual glowing process is structured similarly to a normal glowing process. There, at first a high level of energy is supplied to the glow plugs and subsequently a lower level of energy is supplied, so that the glow plugs quickly reach their temperature and the temperature is then maintained. The longer pre-glowing process is possible because the internal combustion engine and the generator are operated, so that sufficient energy is available.

What is claimed is:

1. A method for controlling at least one glow plug of a motor vehicle, the controlling of the at least one glow plug taking place dependent on an overrun operation of an internal combustion engine, the method comprising:

recognizing an overrun operation when an injected fuel quantity decreases below a threshold quantity for a time period that is longer than a time threshold; and when the overrun operation is recognized, performing during the overrun operation a pre-temperature-regulation of the glow plug through application of a charging current to the glow plug to elevate the temperature of the glow plug to a first predetermined temperature, wherein the elevation of the glow plug temperature in the pre-temperature regulation enables the glow plug to be subsequently heated to a maximum glow temperature within a specified period of time.

2. The method according to claim 1, wherein the specified period of time is less than half a second.

3. The method according to claim 1, wherein the controlling of the glow plug takes place dependent on at least one of the following operating parameters: engine rotational speed, and external temperature.

4. A device for controlling at least one glow plug of a motor vehicle, comprising:

means for recognizing an overrun operation of the motor vehicle when an injected fuel quantity decreases below a threshold quantity for a time period that is longer than a time threshold; and means for performing during the overrun operation, when the overrun operation is recognized, a pre-temperature-regulation of the glow plug through application of a charging current to the glow plug to elevate the temperature of the glow plug to a first predetermined temperature, wherein the elevation of the glow plug temperature in the pre-temperature regulation enables the glow plug to be subsequently heated to a maximum glow temperature within a specified period of time.

5. The device according to claim 4, wherein the specified period of time is less than half a second.

* * * * *

UNITED STATES PATENT AND TRADEMARK OFFICE

CERTIFICATE OF CORRECTION

PATENT NO. : 8,360,024 B2
APPLICATION NO. : 12/223232
DATED : January 29, 2013
INVENTOR(S) : Moritz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1210 days.

Signed and Sealed this
First Day of September, 2015

Michelle K. Lee

Michelle K. Lee
*Director of the United States Patent and Trademark Office*